US012807198B2

(12) United States Patent
Knaus

(10) Patent No.: US 12,807,198 B2
(45) Date of Patent: Nov. 24, 2026

(54) DEFLECTION OF A COUPLER OF A TRAIN VEHICLE, COUPLER OF A TRAIN, CAR OF A MULTI-CAR VEHICLE AND METHOD FOR COUPLING A FIRST CAR OF A MULTI-CAR VEHICLE TO A SECOND CAR OF A MULTI-CAR VEHICLE

(71) Applicant: DELLNER COUPLERS AB, Falun (SE)

(72) Inventor: Eugen Knaus, Peine (DE)

(73) Assignee: DELLNER COUPLERS AB, Falun (SE)

( * ) Notice: Subject to any disclaimer, the term of this patent is extended or adjusted under 35 U.S.C. 154(b) by 925 days.

(21) Appl. No.: 18/011,778

(22) PCT Filed: Mar. 18, 2021

(86) PCT No.: PCT/EP2021/056980

§ 371 (c)(1),
(2) Date: Dec. 20, 2022

(87) PCT Pub. No.: WO2022/008108

PCT Pub. Date: Jan. 13, 2022

(65) Prior Publication Data

US 2023/0234624 A1 Jul. 27, 2023

(30) Foreign Application Priority Data

Jul. 9, 2020 (EP) ..... 20185067

(51) Int. Cl.

| | |
|---|---|
| ***B61G 7/12*** | (2006.01) |
| ***B61G 7/02*** | (2006.01) |
| ***B61G 7/08*** | (2006.01) |

(52) U.S. Cl.
CPC ..... *B61G 7/12* (2013.01); *B61G 7/02* (2013.01); *B61G 7/08* (2013.01)

(58) Field of Classification Search
CPC ... B61G 7/02; B61G 7/06; B61G 7/08; B61G 7/12
See application file for complete search history.

(56) References Cited

U.S. PATENT DOCUMENTS 4,013,175 A * 3/1977 Klein ..... B61G 7/12 213/20
2005/0121404 A1* 6/2005 Sprave ..... B61G 7/12 213/75 R (Continued)

FOREIGN PATENT DOCUMENTS

CN 107667050 A 2/2018
CN 110271578 A 9/2019

(Continued)

OTHER PUBLICATIONS

International Search Report and Written Opinion in PCT Application No. PCT/EP2021/056980 mailed on Aug. 26, 2021, 11 pages.

*Primary Examiner* — Zachary L Kuhfuss
(74) *Attorney, Agent, or Firm* — Howard IP Law Group PC

(57) ABSTRACT

A device for deflection of a coupler of a train vehicle, comprising a deflection arm adapted to be connected to a coupler pivot anchor and a drive connected to the deflection arm, whereby the drive is configured to rotate the deflection arm about the coupler pivot anchor.

17 Claims, 16 Drawing Sheets

(56) References Cited

U.S. PATENT DOCUMENTS

| | | | | |
|---|---|---|---|---|
| 2014/0284297 | A1* | 9/2014 | Peckham | B61G 7/12 213/75 R |
| 2016/0090110 | A1* | 3/2016 | Ueda | B61G 5/02 213/74 |
| 2017/0021844 | A1* | 1/2017 | Skowronek | B61G 7/12 |

FOREIGN PATENT DOCUMENTS

| | | | |
|---|---|---|---|
| CN | 210391159 | U | 4/2020 |
| DE | 3037407 | A1 | 5/1982 |
| DE | 20120581 | U1 | 6/2003 |
| EP | 1129920 | A1 | 9/2001 |
| EP | 3072772 | A1 | 9/2016 |
| WO | 2012026865 | A1 | 3/2012 |
| WO | 2015121479 | A1 | 8/2015 |
| WO | 2016131716 | A1 | 8/2016 |
| WO | 2017157738 | A1 | 9/2017 |

* cited by examiner

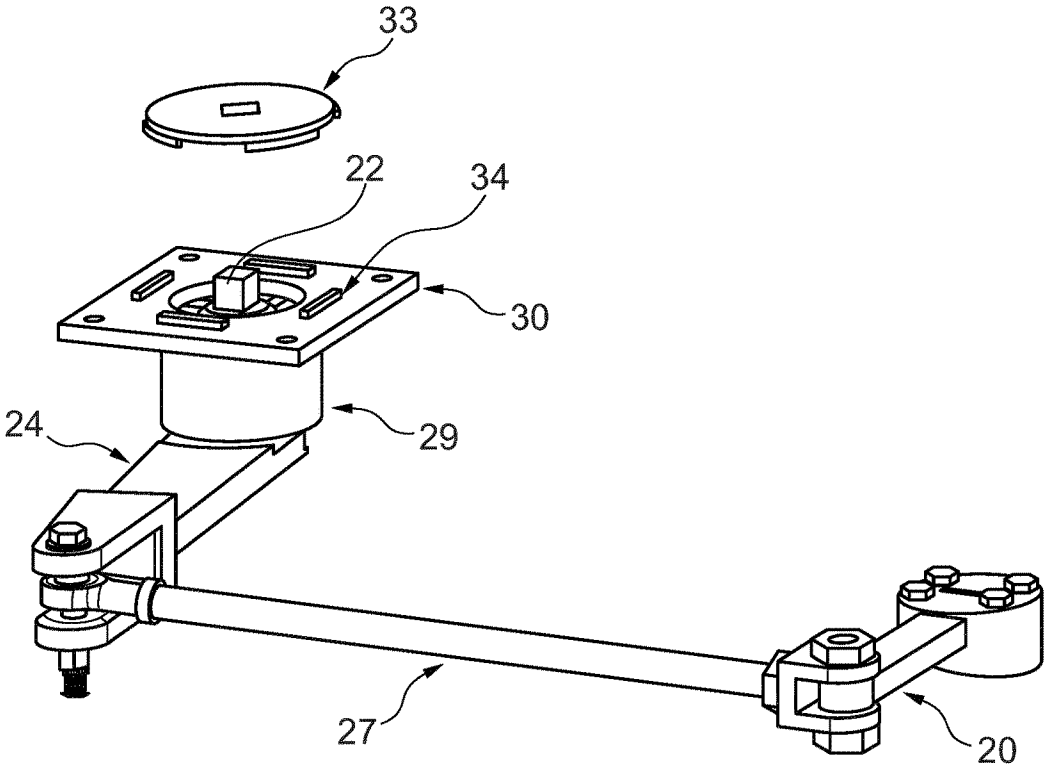
Fig. 5
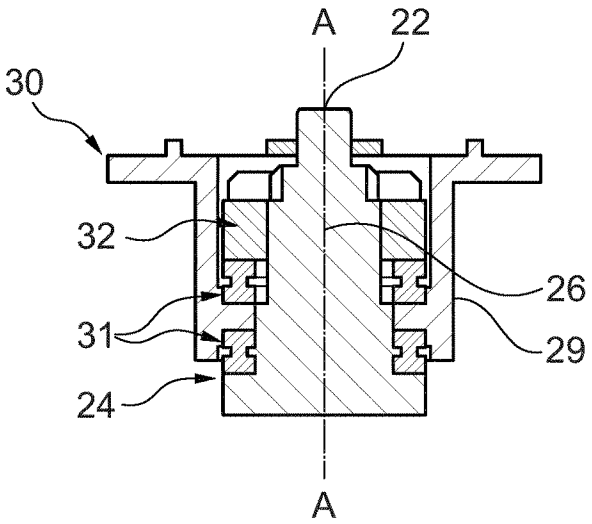

DEFLECTION OF A COUPLER OF A TRAIN VEHICLE, COUPLER OF A TRAIN, CAR OF A MULTI-CAR VEHICLE AND METHOD FOR COUPLING A FIRST CAR OF A MULTI-CAR VEHICLE TO A SECOND CAR OF A MULTI-CAR VEHICLE

CROSS-REFERENCE TO RELATED APPLICATIONS

This application is the national stage application under 35 U.S.C. § 371 of International Application No. PCT/EP2021/056980 filed Mar. 18, 2021, which claims priority to EP 20185067.4 filed on Jul. 9, 2020, the entire disclosures of which are incorporated herein by reference in their entireties.

FIELD OF INVENTION

The invention relates to a device for a deflection, preferably a manual deflection of a coupler of a train vehicle, especially the coupler is of the type of an automatic coupler. The invention also relates to coupler of a train, a car of a multi-car vehicle and a method for coupling a first car of a multi-car vehicle to a second car of a multi-car vehicle.

BACKGROUND

A device for deflection of a coupler of a train is known from WO 2016/131716 A1 and WO 2017/157738 A1. In both devices drives are provided that are connected to the car body on one end and are connected to the coupler rod of the coupler with their opposite end. Activating the drive allows to swivel the coupler rod about the coupler pivot anchor. The devices known from the two documents can be used to couple a first car of a multi-car vehicle with a second car of a multi-car vehicle even in situations, where the first car and the second car are not aligned along a straight line, but are positioned along a curved track.

SUMMARY

It is an object of the invention to further improve a device for deflection of a coupler of a train vehicle. This object is solved by the device, coupler, car of a multi-car vehicle, and method according to embodiments of the present disclosure.

The invention works with the basic concept to have a deflection arm adapted to be connected to a coupler pivot anchor and to have a drive that is connected to the deflection arm, whereby the drive is suitable to rotate the deflection arm about the coupler pivot anchor.

The invention hence breaks away from the basic concept described in the WO 2016/131716 A1 and WO 2017/157738 A1, whereby a drive is provided that directly acts on the coupler rod. Instead of interacting with the coupler rod, the device according to the invention is designed to interact with the coupler pivot anchor. By way of not interacting with the coupler rod, but by interacting with the coupler pivot anchor the invention provides the advantage that the coupler rod can be designed without having to take into account the attachment of a drive to the coupler rod. Hence the coupler rod can be provided with dampers or with deformation elements and/or can be designed to incorporate further features without having to take care about the possibility of a connection for the drive to be provided. Furthermore, in a preferred embodiment, the drive can be situated in an area that is arranged horizontally above or below the horizontal plane, in which the coupler rod typically swivels in normal driving conditions. The invention hence allows for a design that leaves more free space for movements of the coupler rod without the risk of the coupler rod hitting elements of the drive.

The invention relates to a device for deflection of a coupler of a train vehicle. The device for deflection of a coupler is considered to be a sub-system of a coupler. It is feasible that the device according to the invention can be retro-fitted to already existing couplers of trains.

The device according to the invention is described in conjunction with a coupler of a train vehicle. The predominant field of application for the invention will be railway vehicles (railway trains). The term "train" is, however, to be understood broadly. Within the concept of the invention it is also feasible that the invention is applied to multi-car vehicles that are not railway vehicles, for example applied to segmented buses or magnetic trains.

The device according to the invention is provided for deflection of a coupler. The coupler can be any coupler that is suitable to couple a first car of a multi-car vehicle with a second car of a multi-car vehicle. Hence the coupler could be a hook and a ring or two hooks inter-engaging with each other. In a preferred embodiment, the coupler is an automatic coupler, however. The coupler can be what is known to be a latch type coupler. The coupler can especially be of the type that are being referred to in the industry as Wedgelock, Williamson, SA3, AAR, BSI.

In a preferred embodiment the deflection arm has a pivot anchor end, whereby the pivot anchor end is adapted to be attached to a pivot pin of the coupler pivot anchor. In a preferred embodiment, the attachment of the pivot anchor end to the pivot pin is detachable, for example provided by a screw connection or a bayonet connection. In an alternative, likewise preferred embodiment, the attachment of the pivot anchor end to the pivot pin is solid, for example provided by way of the pivot anchor end being welded to the pivot pin or being formed as one piece with the pivot pin.

In a preferred embodiment, the pivot anchor end has a contact surface that is intended to contact a contact surface of the pivot pin. In a preferred embodiment, the contact surface is a slanted surface that slants at an angle to the horizontal plane, whereby the horizontal plane is considered to be the plane perpendicular to the pivot axis. In a preferred embodiment the slanted surfaces slants at an angle of between 10° to 60°, preferably of between 10° to less than 45° to the horizontal plane.

In a preferred embodiment, the pivot pin has contact surface is a slanted surface that slants at an angle to the horizontal plane, whereby the horizontal plane is considered to be the plane perpendicular to the pivot axis. In a preferred embodiment the slanted surfaces slants at an angle of between 10° to 60°, preferably of between 10° to less than 45° to the horizontal plane. In a preferred embodiment, the contact surface of the pivot anchor end and the contact surface of the pivot pin are arranged in parallel and contact each other.

In a preferred embodiment, the deflection arm is a rod, whereby the pivot anchor end of the deflection arm is provided by a thickened end of the rod, preferably a disc-shaped or cylindrical end piece of the rod. Having the pivot anchor end thicken relative to the remaining rod increases the room available to place screws that screw the deflection arm to the pivot pin.

In a preferred embodiment, the drive is a pneumatic drive. In addition to or as an alternative, the drive is a hydraulic drive. Typically, a train already has a pneumatic system and/or a hydraulic system. Existing pneumatic system and/or hydraulic system of the train can preferably be used to energize a pneumatic drive and/or a hydraulic drive.

The preferred embodiment the drive has a deflection arm end that is connected to the deflection arm and has a train vehicle side end that is suitable to be connected to a part of the train vehicle. In a preferred embodiment the train vehicle side end has a plate that can be attached to a part of the train. In a preferred embodiment, the plate can be bolted to a part of the train vehicle. In a preferred embodiment the train vehicle side end has a joint that connects the train vehicle side end to a further element of the drive, preferably a rod. The joint allows the further element of the drive, preferably allows the rod to swivel relative to the train vehicle side end. In a preferred embodiment, the joint allows the further element, preferably allows the rod to swivel relative to the train vehicle side end about a rotational axis. Preferably the rotational axis is orientated parallel to an outward facing surface of a plate that provides the train vehicle side end. In addition or as an alternative the rotational axis is a vertical axis.

In a preferred embodiment, the drive has one, preferably two hydraulic or pneumatic cylinders arranged between the train vehicle side end and the deflection arm end. In a preferred embodiment a rod that at its end has the vehicle side end is a rod of a first hydraulic or pneumatic cylinder and a rod that at its end has the deflection arm end is a rod of a second hydraulic or pneumatic cylinder. In a preferred embodiment, the rod of the first hydraulic or pneumatic cylinder is arranged in parallel to the rod of the second hydraulic or pneumatic cylinder. In a preferred embodiment the first hydraulic or pneumatic cylinder is attached to the second hydraulic or pneumatic cylinder.

In a preferred embodiment the deflection arm has a drive end that is connected to the drive and has a pivot anchor end that is adapted to be connected to a coupler pivot anchor. In a preferred embodiment the drive end is connected to the drive by way of a joint. In a preferred embodiment, the drive end is connected to an element of the drive, preferably a rod by way of the joint. In a preferred embodiment, the joint allows the drive end of the deflection arm to swivel relative to the element of the drive, preferably a rod of the drive about a rotational axis. A preferred embodiment, the rotational axis of the joint that connects the drive end of the deflection arm with the drive runs parallel to the rotational axis of the joint that connects the train vehicle side end with a further element of the drive. In an alternative or in addition, the rotational axis of the joint that connects the drive end of the deflection arm to the drive is a vertical axis.

In a preferred embodiment the drive contains a mechanical interface that is adapted for engagement with a tool wherein the mechanical interface can be rotated by the tool. The mechanical interface can be a non-round end of a shaft. The mechanical interface can be a rectangular end of a shaft or a triangular end of a shaft or a polygonal end of a shaft or an ellipse to ellipsoidal end of a shaft. In essence, the shape of the shaft can be any of those designs that are known from wrenches. Hence also a TORX geometry is feasible. The purpose of the mechanical interface is to allow a tool to be engaged with the mechanical interface and by way of the geometric design of the mechanical interface and the tool to allow the tool to rotate the mechanical interface. Designs of the mechanical interface are also feasible as they are known from screwdrivers. Hence the mechanical interface could have a slit for the engagement of a screwdriver-shaped tool but the mechanical interface could also have a shape as is known from Phillips screwdrivers.

The drive according to the invention can also contain a steering arm that is connected to the mechanical interface. The steering arm at least partially extends from the connection point between the mechanical interface and the steering arm, wherein the steering arm can be rotated around an axis defined by the mechanical interface. Preferably the mechanical interface is in an operative connection with the shaft, preferably forms part of the shaft, preferably forms the end of the shaft, from which shaft the steering arms extends at an angle different than 0°, preferably at an angle of 90°. In a preferred embodiment, the shaft has a shaft axis. In a preferred embodiment, the engagement of the tool with the mechanical interface allows a rotation of the tool to be translated into a rotation of the shaft around the shaft axis. In a preferred embodiment the rotation of the shaft around the shaft axis leads to a rotation of the steering arm around the shaft axis. In a preferred embodiment, the steering arm is fixedly connected to the shaft.

In a preferred embodiment, the mechanical inter-face is housed in an attachment housing intended for attachment with a part of the train. The attachment housing can have an attachment plate intended for providing the attachment interface of the attachment housing to a part of the train. In a preferred embodiment at least one axial bearing, preferably two axial bearings for a shaft are arranged in the attachment housing. Preferably the mechanical interface is arranged at the end of the shaft. In a preferred embodiment, the shaft extends across the attachment housing along the shaft axis.

In a preferred embodiment, a pre-tensioning nut is arranged in the attachment housing.

The pretension nut provides a preload to the axial bearings, for example to reduce the wear in the rotating parts.

The manual centering tool ensures a centering function during the operation, when the coupler is placed in a centered position. The centering tool can prevent the coupler from swinging to the one side or the other unattended. The manual centering tool can be placed on the manual deflection device in case of uncoupled daily operation and will be removed, when it is required to drive coupled or necessary to deflect the coupler in service or for coupling in tight curves.

In a preferred embodiment of the drive, the deflection arm is directly or indirectly connected to the steering arm. In a direct connection, one end of the steering arm is connected to the drive end of the deflection arm. In such an embodiment, a joint is preferably provided for connecting the drive end of the deflection arm with an end of the steering arm allowing the deflection arm to swivel relative to the steering arm. An indirect connection between the deflection arm and the steering arm is provided if an additional element is arranged between the deflection arm and the steering arm. In a preferred embodiment, a connection arm is arranged between the steering arm and the deflection arm. In a preferred embodiment, one end of the connection arm is connected to one end of the steering arm and the opposite end of the connection arm is connected to the drive end of the deflection arm.

In a preferred embodiment, the deflection arm and/or the steering arm and/or the connection arm is a rod.

The pneumatic deflection device can be based on two dual working cylinders that are placed reciprocal to each other. Both cylinders are pressurized in a centered position in such a way, that one cylinder is extracted and the other is detracted. For deflection to one side the extracted cylinder will be detracted, whiles the other cylinder remains detracted. For deflection of the coupler to the other side the other cylinder will be extracted whiles the first cylinder remains extracted. In a coupled arrangement both cylinders are ventilated in both chambers and are not creating any resistance on the coupler for driving through curves.

The invention also relates to a coupler of a train. The coupler comprises a coupler pivot anchor and a device according to the invention. In a preferred embodiment the deflection arm is connected to the coupler pivot anchor. In a preferred embodiment, the coupler has a coupler rod. In a preferred embodiment, the drive is not directly connected to the coupler rod. In a preferred embodiment, the coupler has a coupler head. In a preferred embodiment, the coupler head is the coupler head of an automatic coupler.

In a preferred embodiment the coupler pivot anchor has a pivot pin that extends along a pivot axis, whereby the coupler rod is connected to the pivot pin in such a way that a rotation of the pivot pin around the pivot axis leads to the coupler rod swiveling about the pivot axis. This can be provided by the pivot pin being connected to the coupler rod in a manner to transmit rotational forces from the pivot pin to the coupler rod. This can be provided by projections from the pivot pin, for example hooks, that directly engage with the circumferential surface of the coupler rod from the side, whereby the rotation of the pivot pin and hence the hooks from the pivot pin around the pivot axis leads to the hooks engaging the side of the coupler rod and pushing the coupler rod to swivel about the pivot axis.

In a preferred embodiment a cage is provided whereby the pivot pin is fixedly attached to the cage, the cage having an opening, whereby the coupler rod extends through the opening of the cage, whereby elastic elements are arranged inside the cage, the elastic elements resting against an inside wall of the cage and resting against an outer circumferential surface of the coupler rod. The elastic elements preferably are rubber donuts that sit on the coupler rod, preferably resting against protruding walls that protrude from the circumferential surface of the coupler rod and protruding walls that protrude from the inner wall of the cage.

In a preferred embodiment an additional pivot pin is arranged on the opposite side of the cage such that the cage can be held by a pivot pin on the top and a pivot pin on the bottom in a bracket of the coupler pivot anchor.

In a preferred embodiment, the coupler pivot anchor has a flange that allows the coupler pivot anchor to be connected to the car body of a train, preferably the underframe of the car.

The invention also relates to a car of a multi-car vehicle, preferably a train. The car comprising a coupler according to the invention. In a preferred embodiment the drive has a train vehicle side end and the train vehicle side end is connected to a part of the car of the multi-car vehicle, preferably the train vehicle.

The method according to the invention provides for coupling a first car of a multi-car vehicle with a second car of a multi-car vehicle, whereby the first car has a coupler having a coupler head and the second car has a coupler having a coupler head, whereby in a first position the coupler head of the first car is misaligned with the coupler head of the second car, characterized in that the coupler head of the first car is brought into alignment with the coupler head of the second car by way of driving the drive to rotate the deflection arm about the coupler pivot anchor.

One aspect of the invention is to couple cars, wagons, cabins or the like of train vehicles in curves. The automatic couplers that are provided complicate coupling because of the deflection out of the middle position in the curve.

An alternative or additional aspect of the invention is to provide a device for centering the coupler, preferably in a manual manner, having an overload protection.

The invention provides a device for manual deflection of a coupler of a train vehicle.

The invention provides a device for manual centering of a coupler of a train vehicle.

BRIEF DESCRIPTION OF THE DRAWINGS

Below, the invention will be described with reference to figures that only show examples of the invention. The invention is described by the following figures:

FIG. 5 shows the device together with a device for centering the coupler, preferably in a manual manner, having an overload protection in a perspective view;

Figure 1:
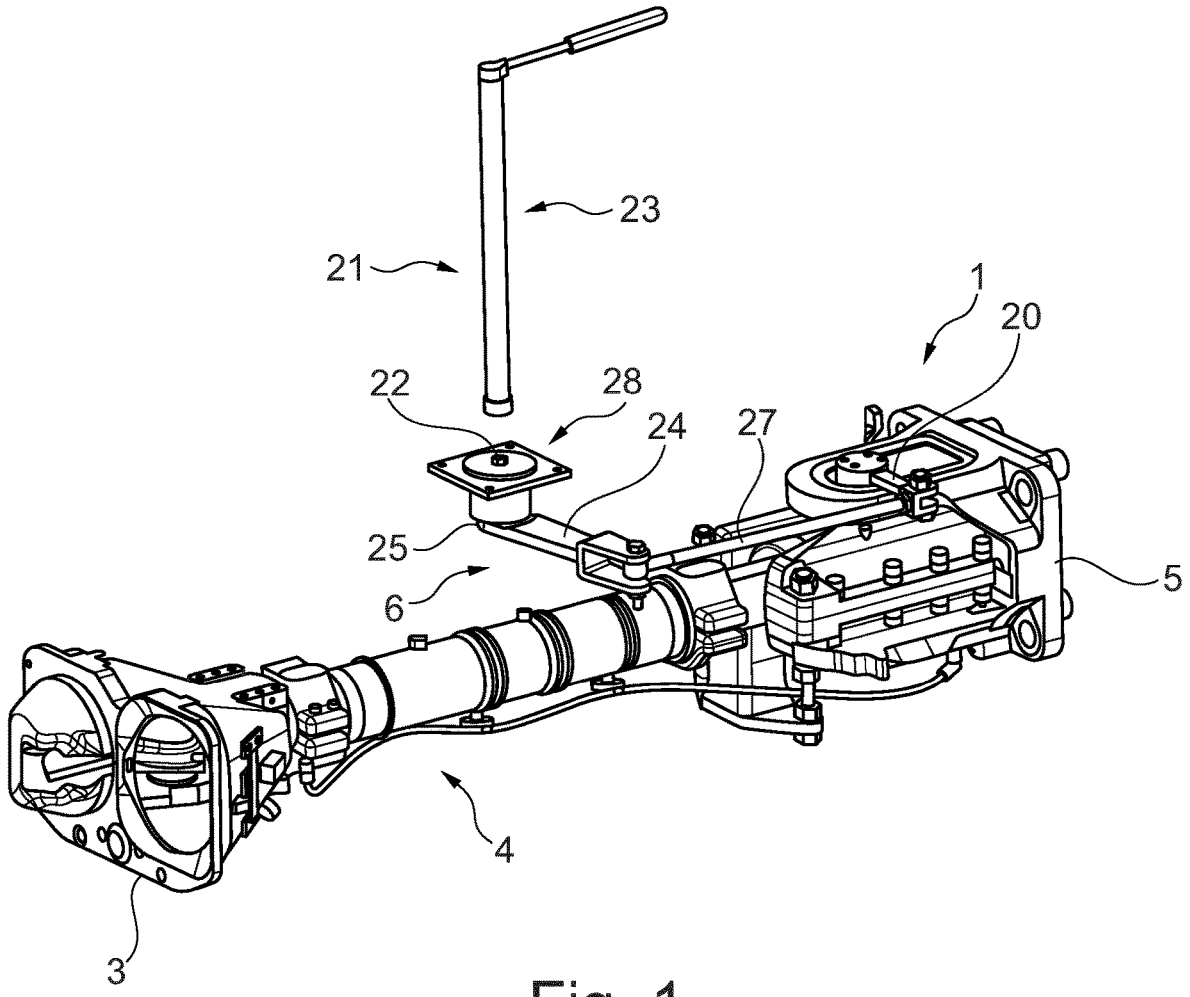
FIG. 1 shows a device for manual deflection of a coupler of a train vehicle together with an automatic coupler and a manual deflection tool in a perspective view.
Figure 3:
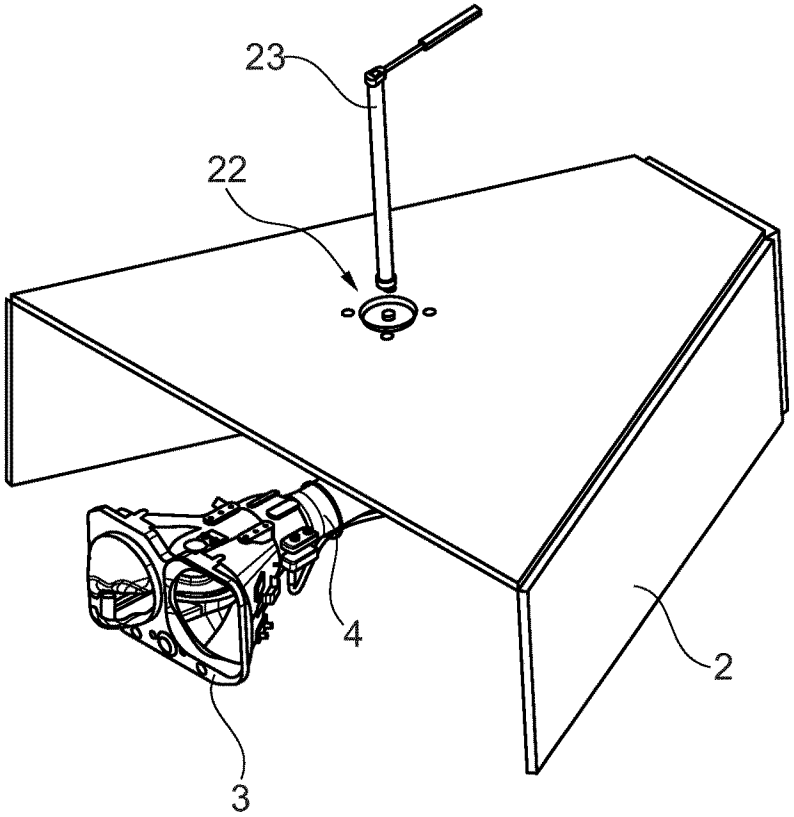
FIG. 3 is an additional view of the device and the floor of the train vehicle seen from above.
Figure 2:
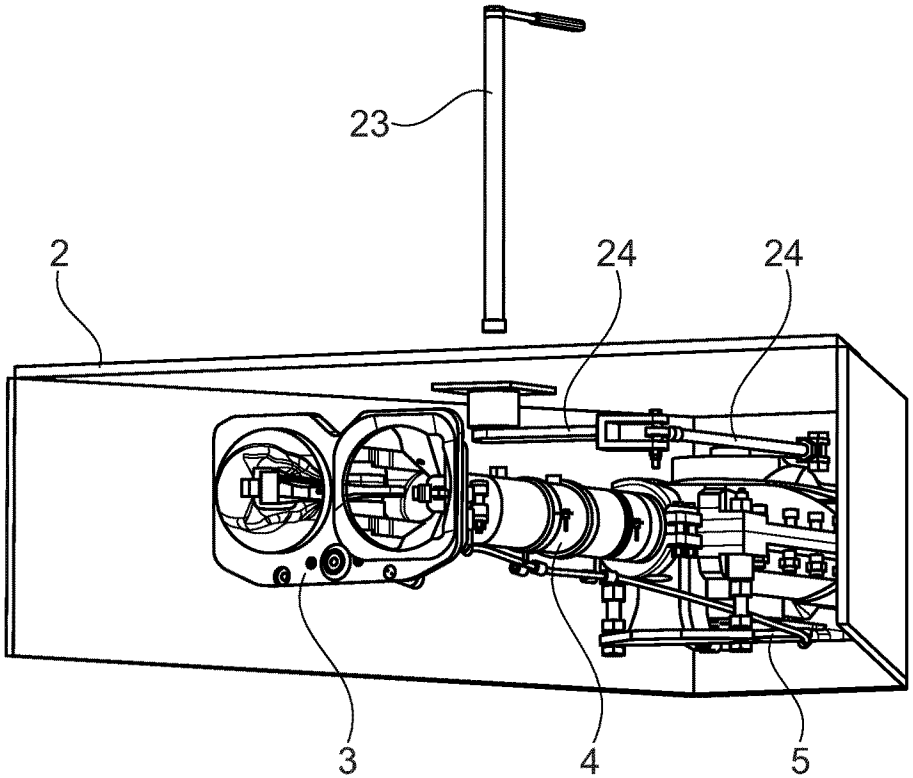
FIG. 2 shows the device together with a floor of the train vehicle seen from the end of the coupler and the manual deflection tool.
Figure 4:
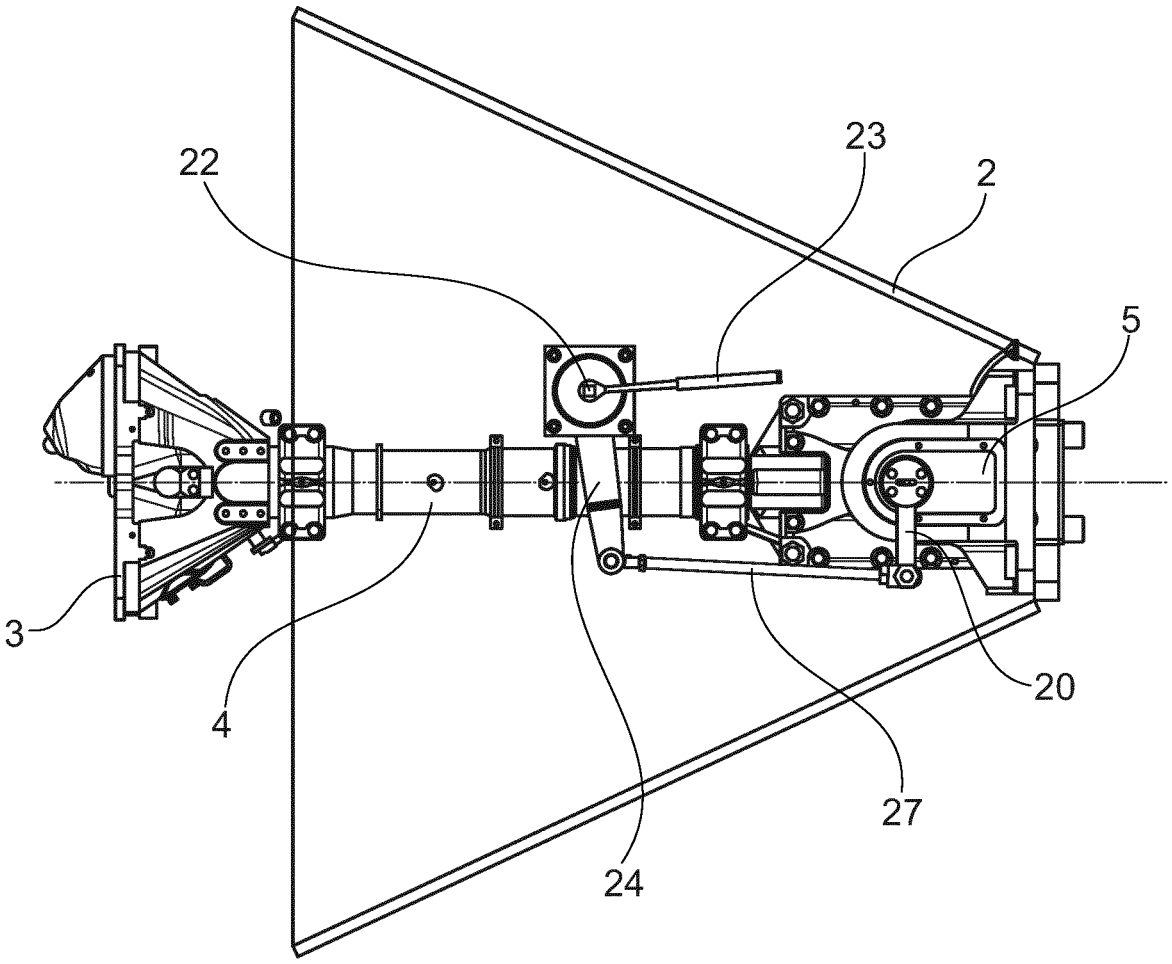
FIG. 4 is an additional view according to FIG. 3 without the floor of the train vehicle.
Figure 6:
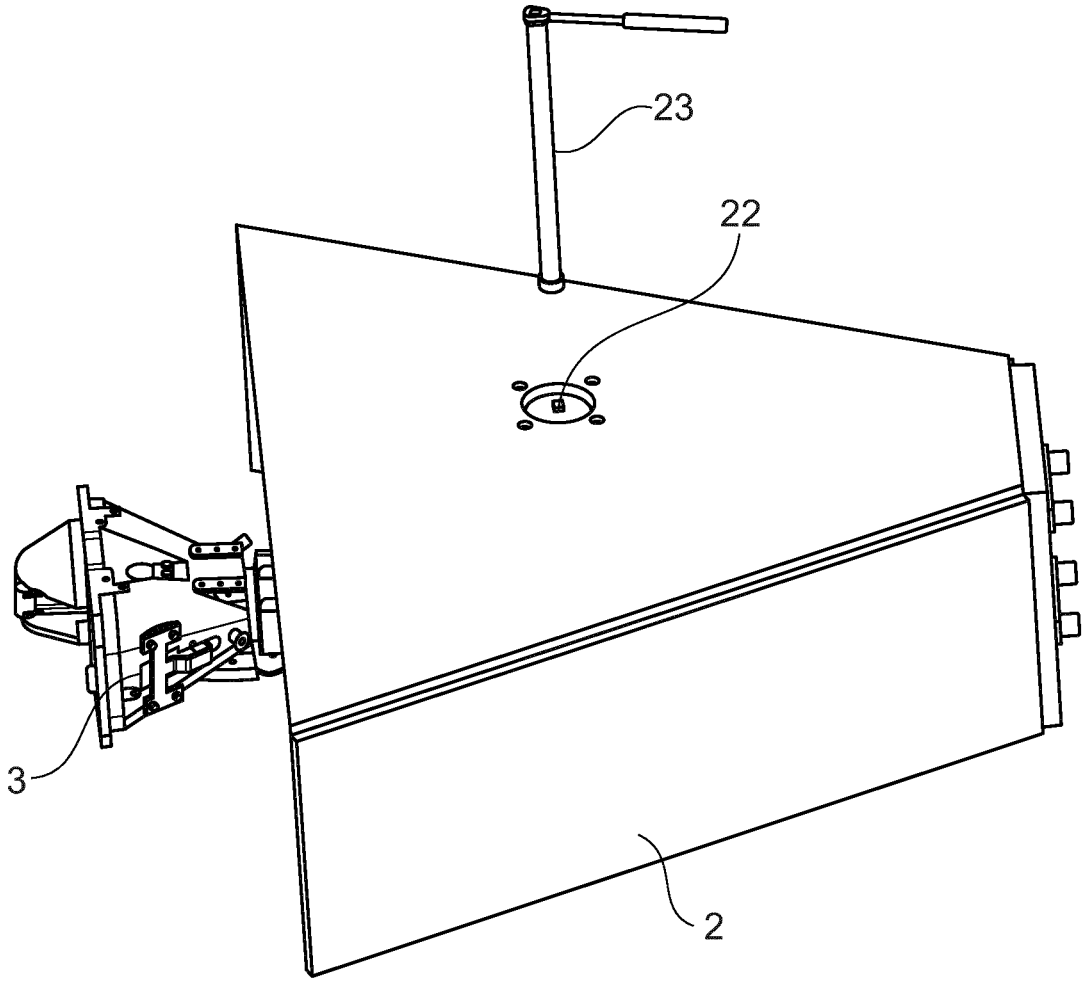
FIGS. 6 to 8 show a sequence for accessing the device for manual deflection of a coupler of a train vehicle.
Figure 7:
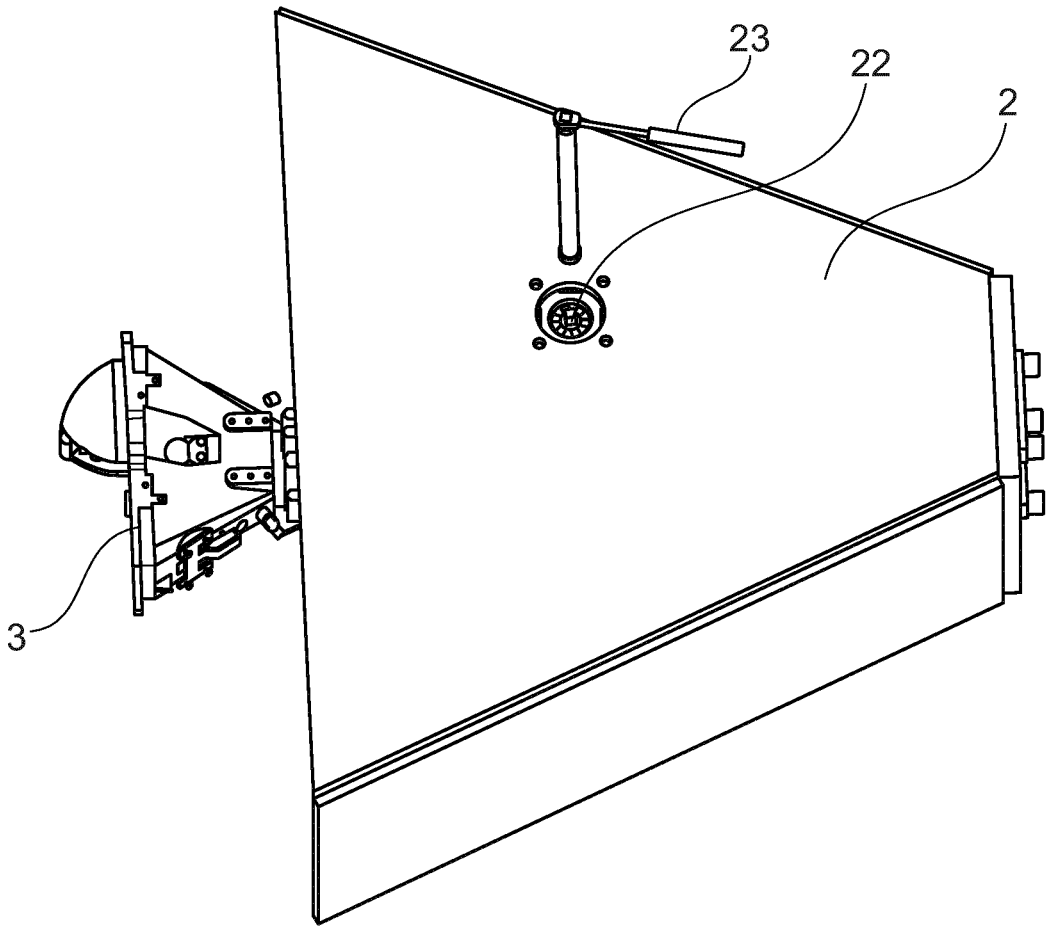
Figure 8:
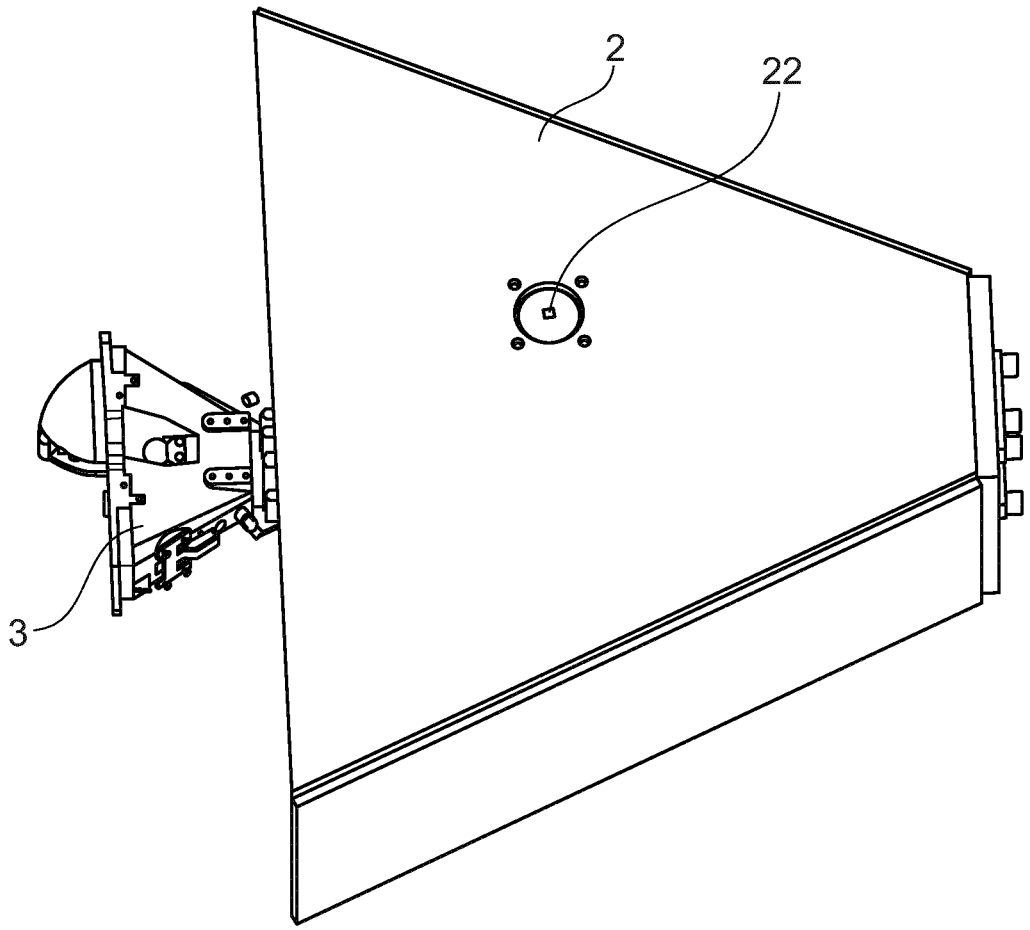

In the drawings, the device for manual deflection of a coupler of a train vehicle is shown together with a device for manual centering of a coupler of a train vehicle, however, the device for manual deflection of a coupler of a train vehicle can also be realized without the features of the device for manual centering of a coupler of a train vehicle.

DETAILED DESCRIPTION

FIGS. 1 to 14 show a coupler 1 of a train vehicle. FIGS. 2, 3, 4, 6, 7, and 8 also show parts 2 of the train vehicle. The coupler 1 has an automatic coupler head 3 and a coupler rod 4. The coupler 1 also has a coupler pivot anchor 5. The coupler 1 also has a device 6 for deflection.

The device 6 comprises a deflection arm 20 and a drive 21.

In the embodiments shown in FIGS. 1 to 8, the drive 21 comprises a mechanical interface 22 adapted for engagement with a tool 23, wherein the mechanical interface 22 can be rotated by the tool 23.

In the embodiments shown in FIGS. 1 to 8, the drive 21 further comprises a steering arm 24 connected to the mechanical interface 23, the steering arm 24 at least partially extending from the connection point 25 between the mechanical interface 22 and the steering arm 24, wherein the steering arm 24 can be rotated around an axis A defined by the mechanical interface 22. The mechanical interface 22 is in operative connection with a shaft 26 from which the steering arm 24 extends at angle different than 0°, namely at an angle of 90°. The deflection arm 20 is indirectly connected to the steering arm 24. A connection arm 27 is connected to the steering arm 24 and the deflection arm 20.

The mechanical interface 22 has a manual centering tool 28 that has an overload protection.

FIG. 5 in the inset Fig. at the left shows a cross section through an attachment housing 29. The attachment housing has an attachment plate 30 for attachment of the attachment housing 29 and the mechanical interface 22 to a piece of the train vehicle. The mechanical interface 22 is formed at the end of the shaft 26. The mechanical interface 22 can be provided as a positive and/or non-positive (form fit or force fit) connection. The shaft 26 runs through the attachment housing 29. Inside the attachment housing 29 two axial bearing 31 for the shaft 26 are provided. Additionally, a pretension nut 32 is arranged inside the attachment housing 29.

The exploded view arranged as part of FIG. 5 shows a manual centering tool 33.

On the attachment plate 30 one or multiple shear out teeth 34 for overload protection are provided.

The shaft 26 has preloaded axial bearings 31 to prevent noise creation during operation and to allow easy coupler deflection when needed.

In order to deflect the coupler head 3 an access hatch (not shown) in the floor of a train vehicle is opened to access the manual deflection device 6, especially the mechanical interface 22. The manual centering tool 28 is removed from the manual deflection device 6. The manual deflection tool 23 is then connected to the manual deflection device 6, especially the manual deflection interface 22. The tool 23 is rotated clockwise in the view of FIG. 7 to move the coupler head 3 to the right. The tool 23 is rotated counter-clockwise in the view of FIG. 7 to move the coupler head 3 to the left. After the operation has been finished, the coupler head 3 is brought back into the centered position and the centering tool is aligned with the mechanical interface 22.

The embodiment shown in FIGS. 9 to 14 shows the coupler 1 to have a drive 21 that is a hydraulic drive. The drive 21 has two hydraulic cylinders 50, 51. Each hydraulic cylinder 50, 51 has a rod 52, 53. Rod 52 is connected to the deflection arm 20 by way of joint 54 at the deflection arm end of the drive 21. Rod 53 is connected to the train vehicle side end of the drive 21 by way of a joint 55. The train vehicle side end of the drive 21 is provided by a plate 26 that is suitable to be attached to a part of the train vehicle by way of bolts.

Figure 12:
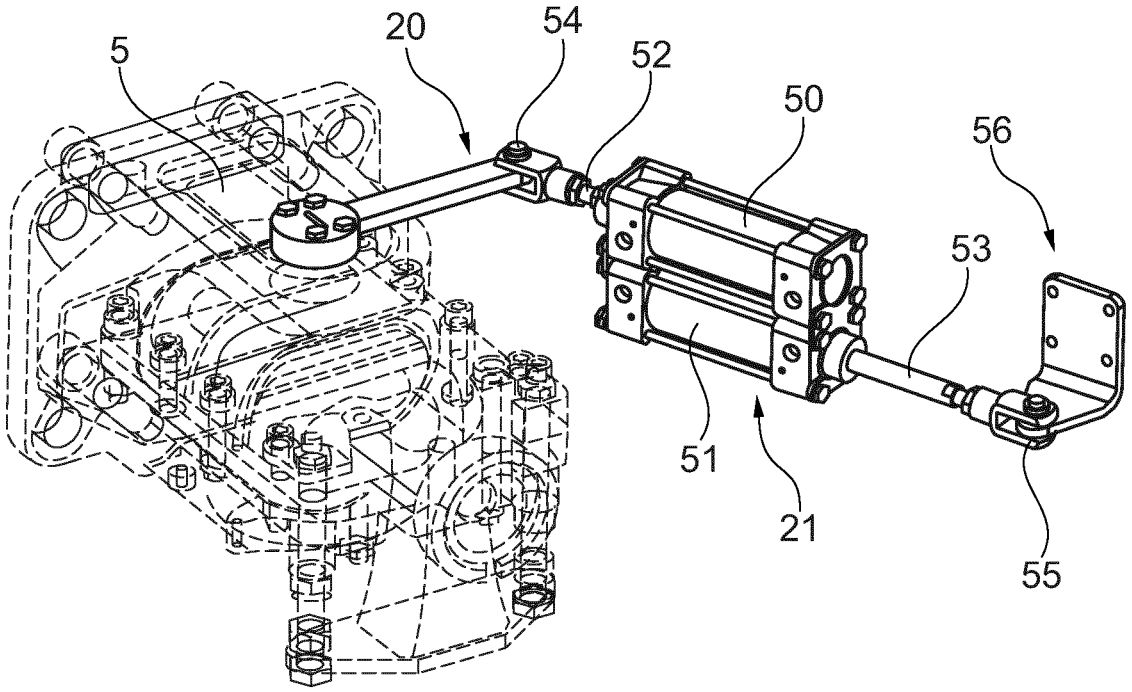
FIG. 12 shows the embodiment of FIG. 9 in a first operational condition.
Figure 13:
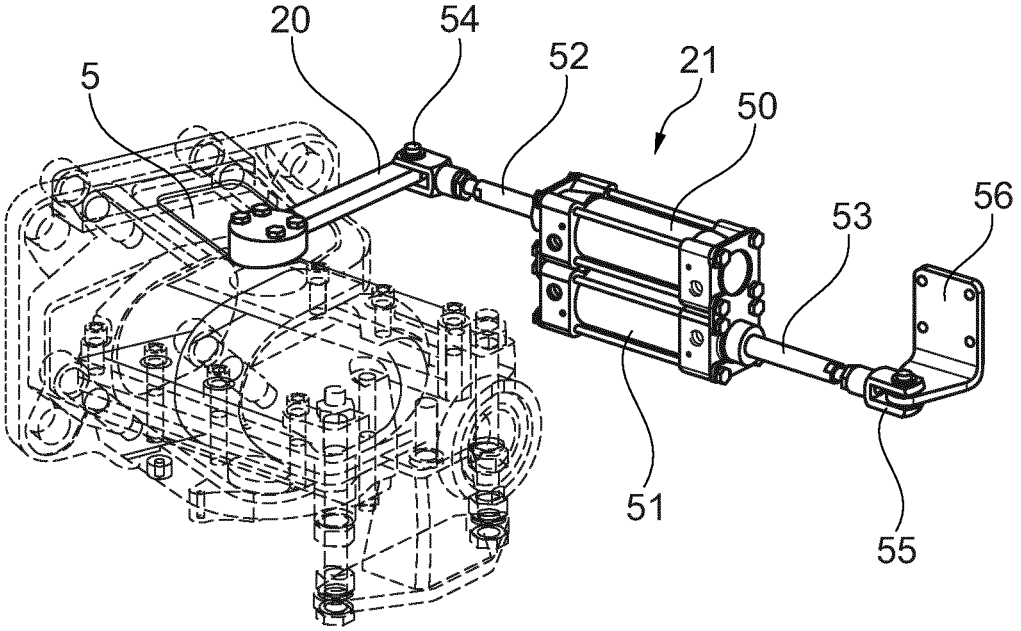
FIG. 13 shows the embodiment of FIG. 9 in a second operational condition.
Figure 14:
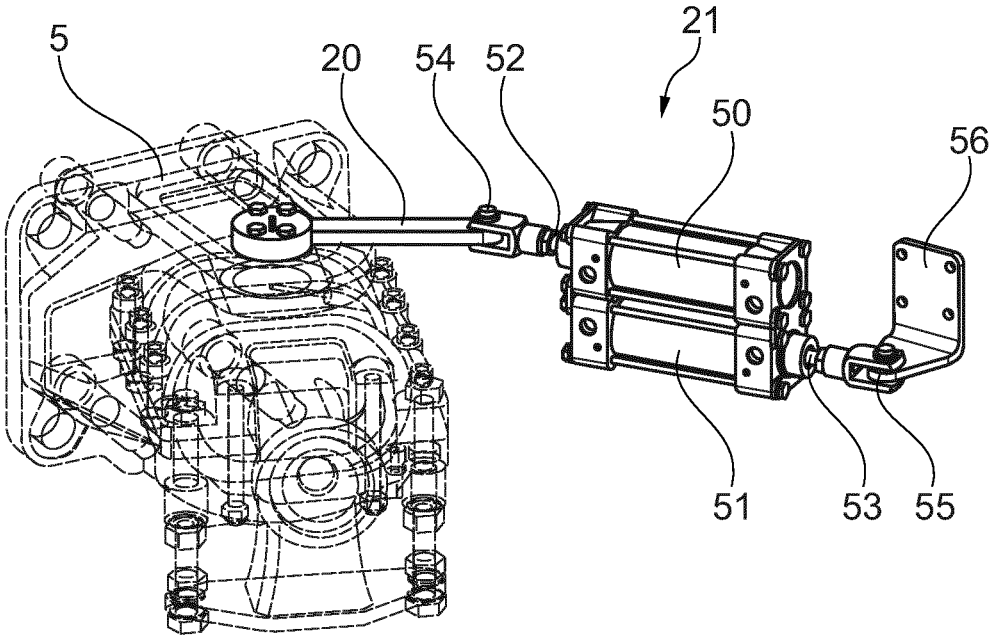
FIG. 14 shows the embodiment of FIG. 9 in a third operational condition.
Figure 15:
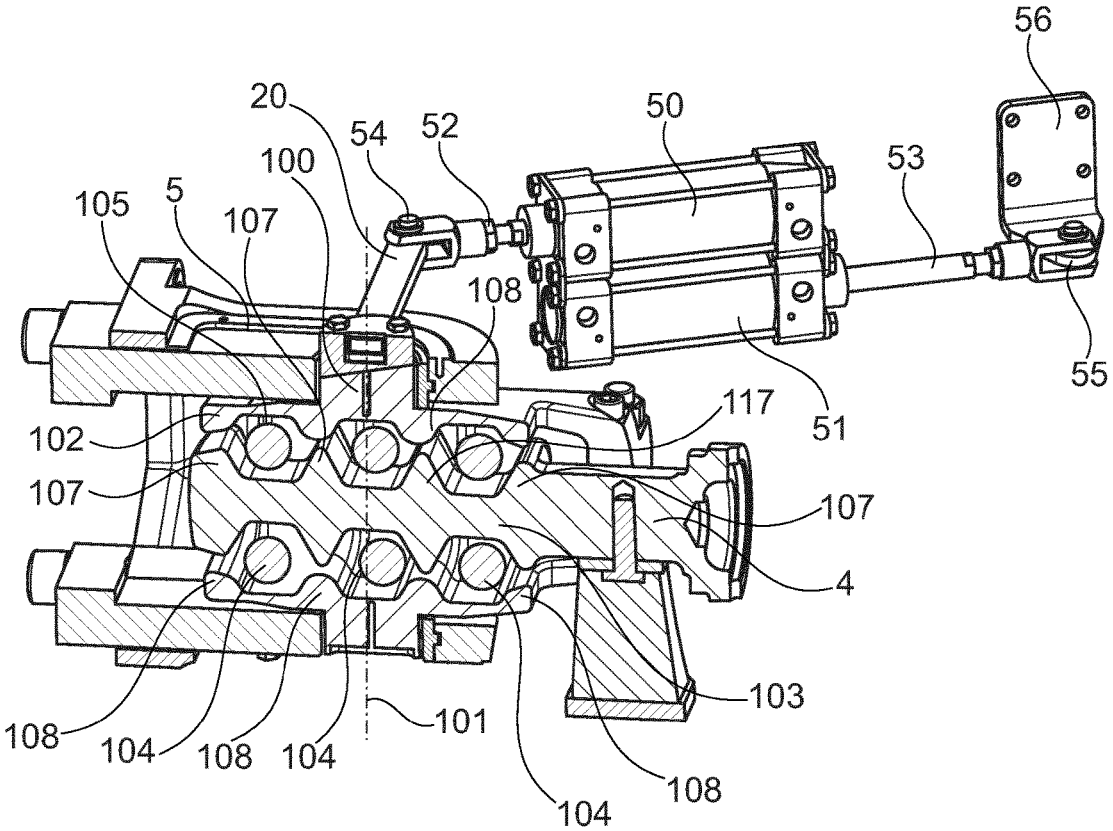
FIGS. 15 to 18 show perspective, partially sectional views of the embodiment of FIG. 9 with the coupler pivot anchor and the parts of the coupler rod being dissected with the elastic elements that form part of the coupler pivot anchor not being shown in FIGS. 16 to 18 for better clarity.
Figure 16:
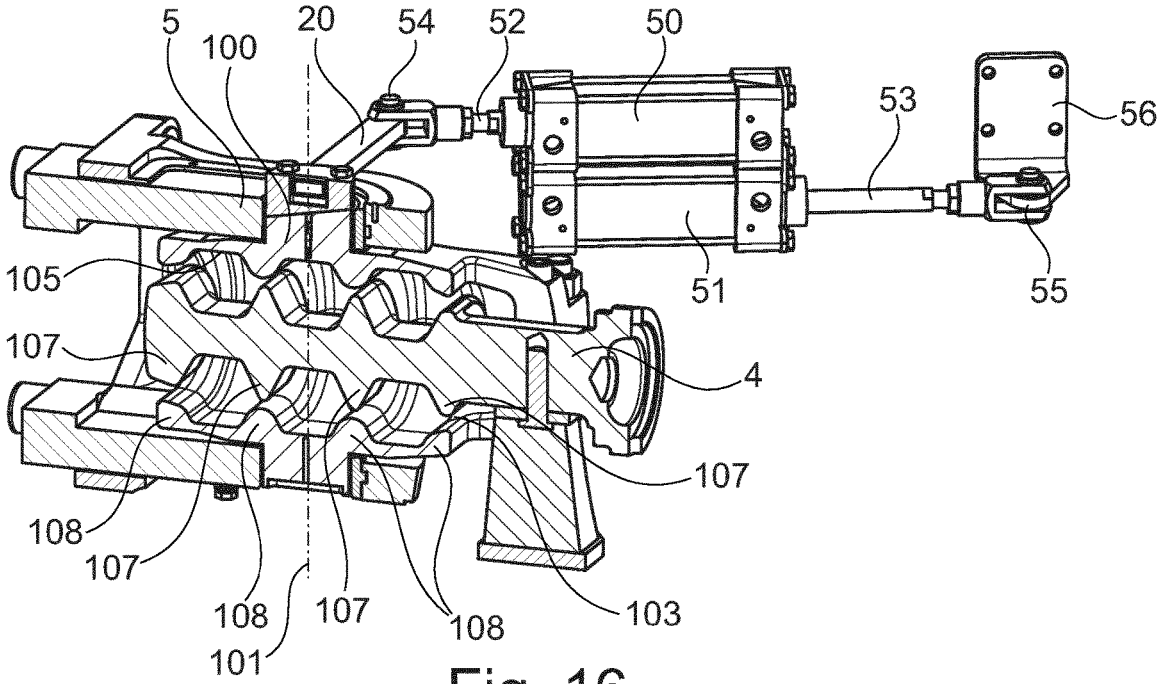
Figure 17:
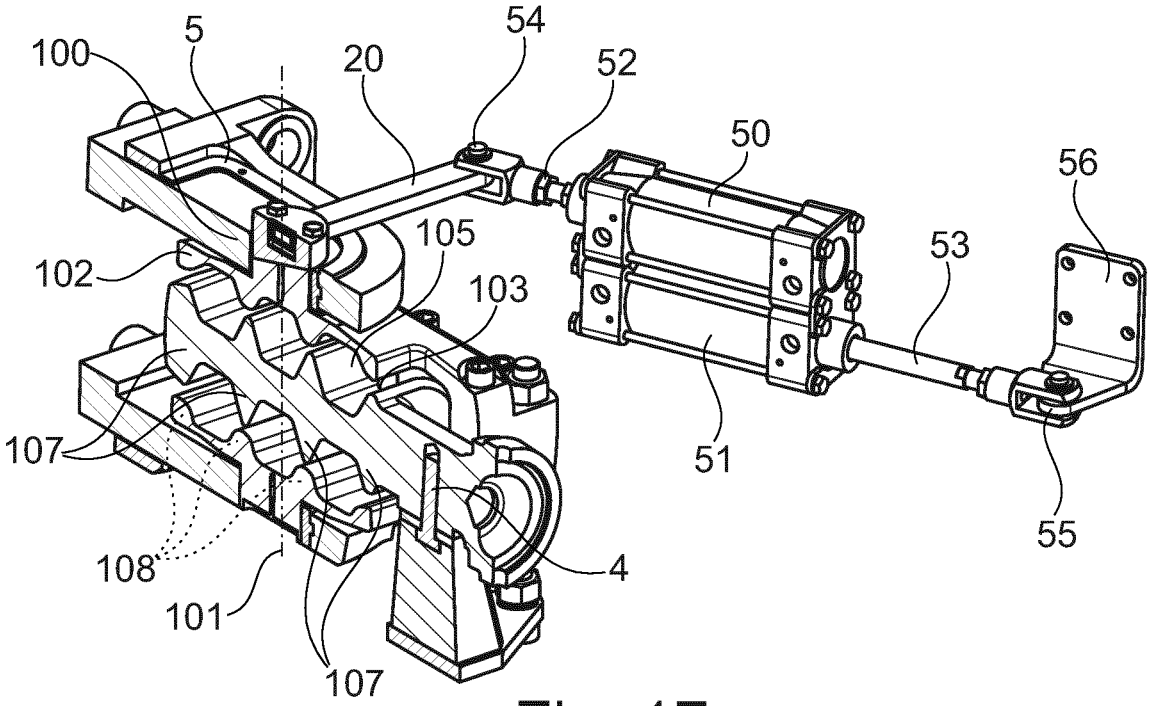
Figure 18:
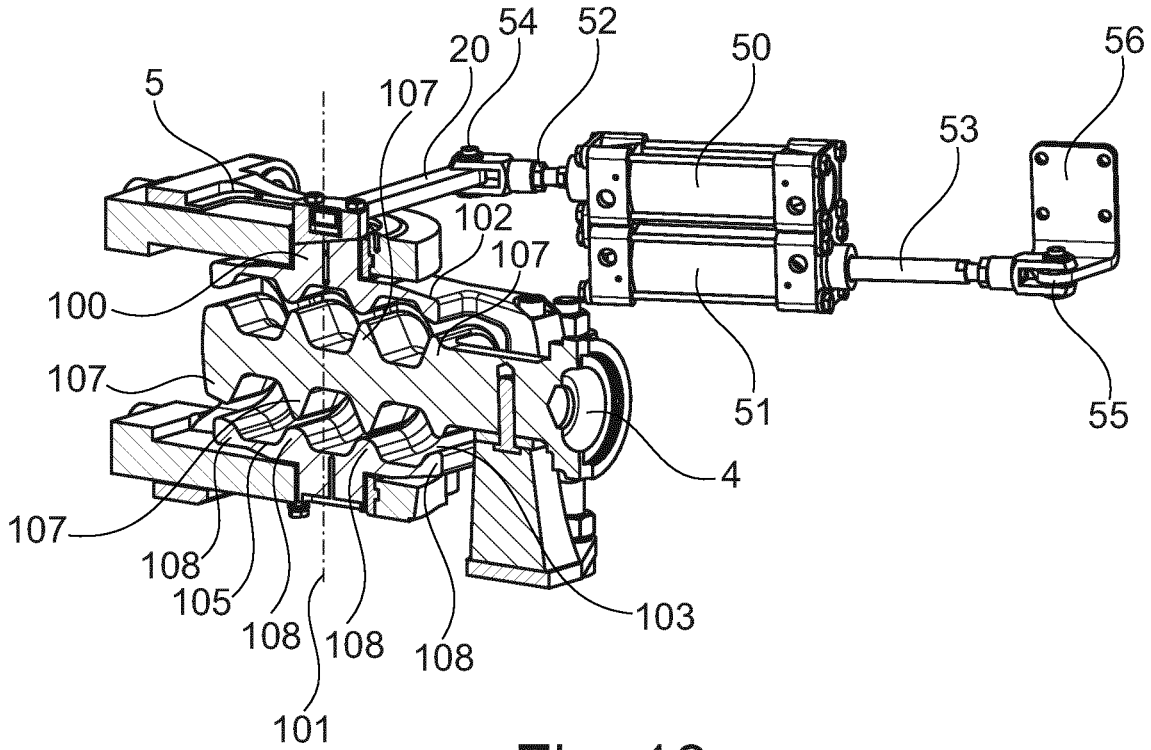
Figure 19:
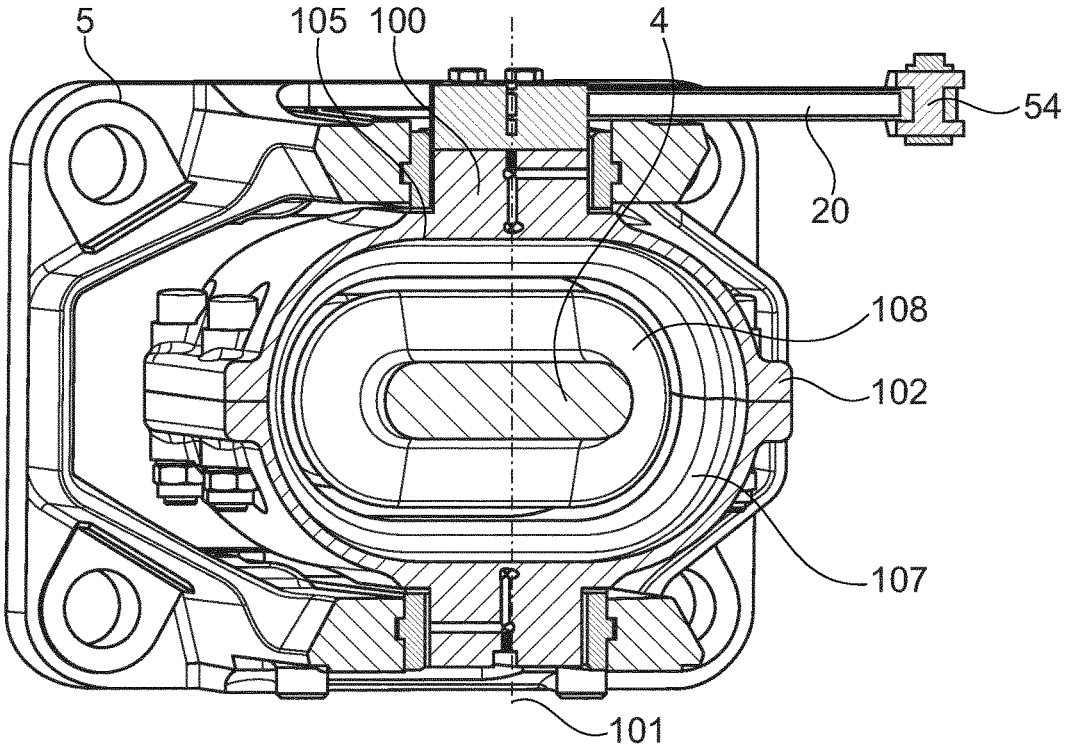
FIGS. 19 to 20 show partially sectional views of the deflection arm, the coupler pivot anchor and parts of the coupler rod of the embodiment of FIG. 9 with the elastic elements that form part of the coupler pivot anchor not being shown for better clarity.
Figure 20:
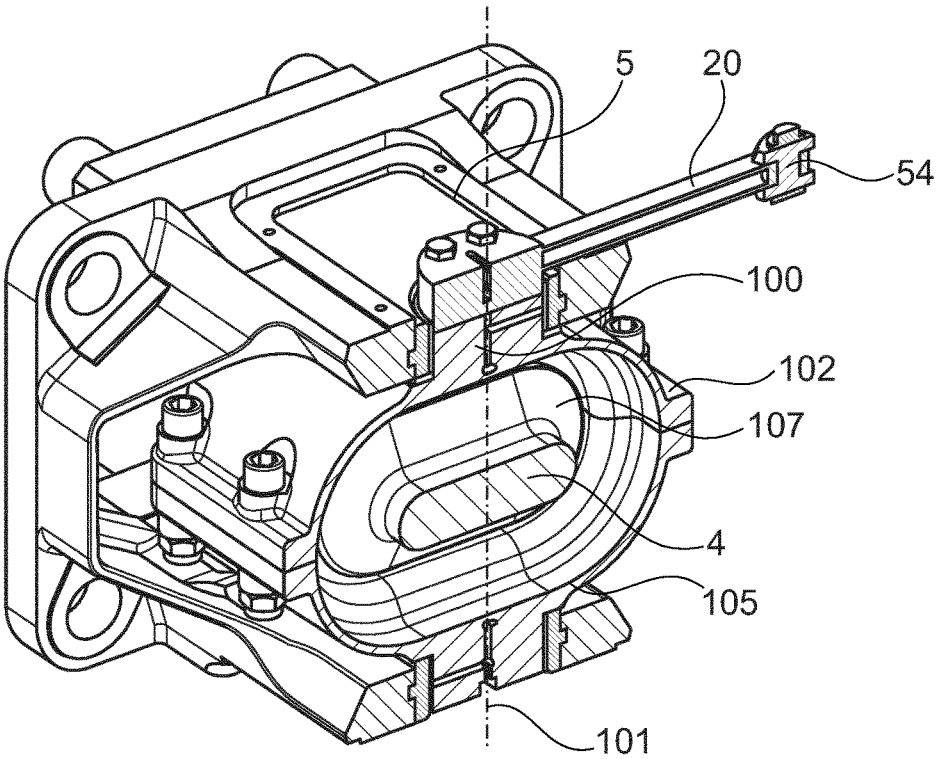

As can be seen in FIG. 13, the deflection condition to the right hand side in the frontal perspective view of FIG. 13 is obtained by extracting the hydraulic cylinder 50 compared to the position shown in FIG. 12. To deflect the coupler to the left hand side in the frontal perspective view of FIG. 14, the upper hydraulic cylinder 50 is retracted compared to the position in FIG. 13, which starting from FIG. 12 means: remains unchanged, while the lower cylinder 51 is retracted compared to the position shown in FIG. 12.

Figure 9:
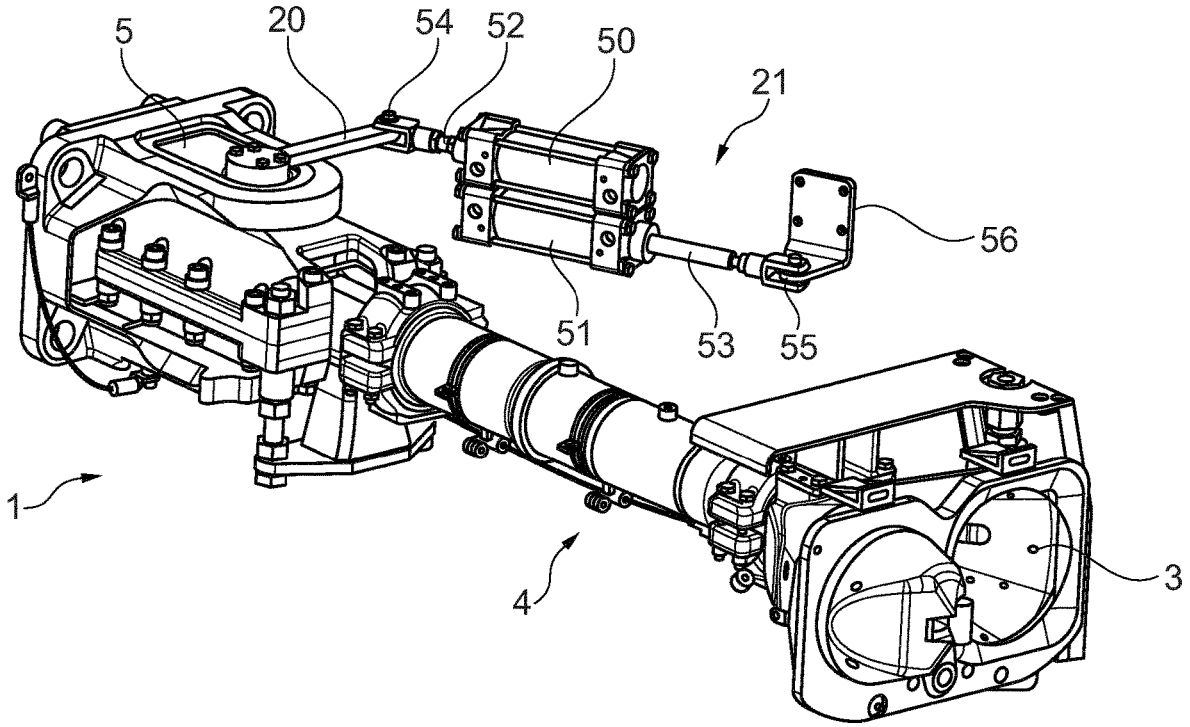
FIG. 9 shows a perspective view onto a second embodiment according to the invention.
Figure 10:
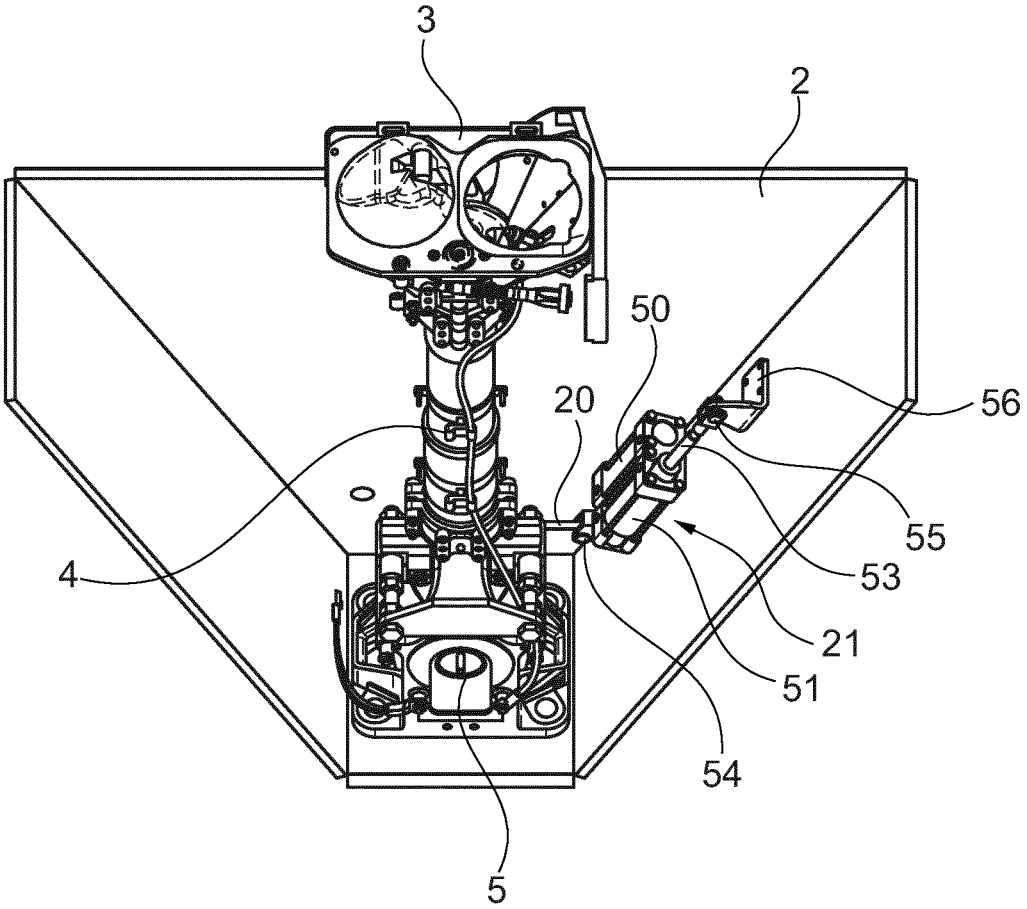
FIG. 10 shows the embodiment of FIG. 9 as attached to a train vehicle.
Figure 11:
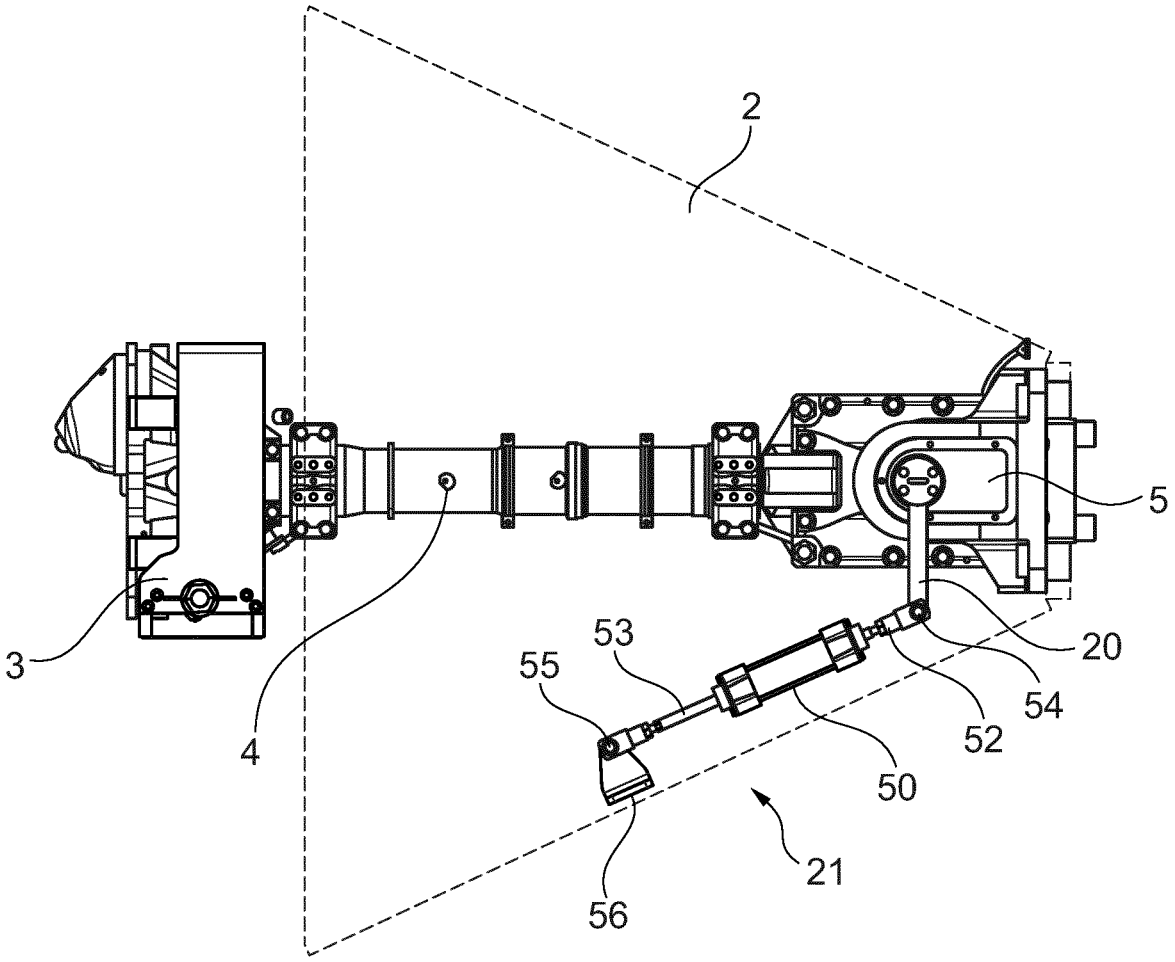
FIG. 11 shows a top view onto the embodiment of FIG. 9.

FIGS. 15 to 20 show the coupler of the embodiment shown in FIG. 9. FIGS. 15 to 20 show that the coupler pivot anchor 5 has a pivot pin 100 that extends along a pivot axis 101, whereby the coupler rod 4 is connected to the pivot pin 100 in such a way that a rotation of the pivot pin 100 around the pivot axis 101 leads to the coupler rod 4 swiveling about the pivot axis 101. For this connection, the coupler pivot anchor 5 has a cage 102, whereby the pin 100 is fixedly attached to the cage 102, the cage 102 having an opening 103, whereby the coupler rod 4 extends through the opening 103 of the cage 102, whereby elastic elements 104 (only shown in FIG. 15) are arranged inside the cage 102, the elastic elements resting against an inside wall 105 of the cage 102 and resting against an outer circumferential surface of the coupler rod 4. The elastic elements 104 are rubber donuts that sit on the coupler rod 4 in between protruding walls 107 that are arranged on the coupler rod 4 and in between protruding walls 108 that are arranged on the inside wall 105 of the cage 102.

As can be seen from FIGS. 15 to 20, the deflection arm 20 has a pivot anchor end, whereby the pivot anchor end is adapted to be attached to a pivot pin 100 of the coupler pivot anchor 5, namely by way of being screwed to the top of the pivot pin 100. Turning the deflection arm 200 about the pivot axis 101 leads to the pivot pin 100 and the cage 102 being turned about the pivot axis 101. Turning the cage 102 about the pivot axis 101 leads to the elastic elements 104 being compressed and exerting a force onto the coupler rod 4 that leads to the coupler rod 4 to swivel about the pivot axis 101.

The invention claimed is:

1. A device for deflection of a coupler of a train vehicle, comprising:

a deflection arm adapted to be connected to a coupler pivot anchor; and a drive connected to the deflection arm, wherein the drive is operative to rotate the deflection arm about the coupler pivot anchor;

wherein the drive comprises two parallel hydraulic or pneumatic cylinders and each of the cylinders has a rod, wherein the two rods extend from the two parallel hydraulic or pneumatic cylinders in opposing longitudinal directions.

2. The device according to claim 1, wherein the drive comprises a deflection arm end connected to the deflection arm, and a train vehicle side end adapted to be connected to a part of the train vehicle.

3. The device according to claim 1, wherein the deflection arm comprises:

a drive end connected to the drive; and a pivot anchor end adapted for connection to a coupler pivot anchor.

4. The device according to claim 3, wherein the pivot anchor end attaches to a pivot pin of the coupler pivot anchor.

5. A device for deflection of a coupler of a train vehicle, comprising:

a deflection arm adapted to be connected to a coupler pivot anchor; and a drive connected to the deflection arm, wherein the drive is operative to rotate the deflection arm about the coupler pivot anchor;

wherein the drive comprises:

a mechanical interface adapted for engagement with a tool, wherein the mechanical interface is rotatable by the tool;

a steering arm connected to the mechanical interface at a connection point, the steering arm at least partially extending from the connection point;

wherein the steering arm is rotatable around an axis (A) defined by the mechanical interface, the mechanical interface operatively connected to a shaft from which the steering arm extends at an angle different than zero degrees; and wherein the deflection arm is directly or indirectly connected to the steering arm.

6. The device according to claim 5, further comprising a connection arm that connects the steering arm and the deflection arm.

7. The device according to claim 5, further comprising an attachment plate for attaching the device to a surface of the train vehicle.

8. The device according to claim 5, wherein the mechanical interface is operatively connected to the shaft from which the steering arm extends at an angle of ninety degrees.

9. The device according to claim 5, wherein the deflection arm comprises:

a drive end connected to the drive; and a pivot anchor end adapted for connection to a coupler pivot anchor.

10. The device according to claim 9, wherein the pivot anchor end attaches to a pivot pin of the coupler pivot anchor.

11. A coupler for a train vehicle comprising:

a coupler pivot anchor; and a device comprising:

a deflection arm connected to the coupler pivot anchor; and a drive connected to the deflection arm;

wherein the drive is operative to rotate the deflection arm about the coupler pivot anchor; wherein the drive has two parallel hydraulic or pneumatic cylinders and each of the two cylinders has a rod, wherein the two rods extend from the two parallel hydraulic or pneumatic cylinders in opposing longitudinal directions.

12. The coupler according to claim 11, wherein said coupler further comprises:

a coupler rod;

wherein the coupler pivot anchor includes a pivot pin that extends along a pivot axis, the coupler rod being connected to the pivot pin such that a rotation of the pivot pin around the pivot axis leads to the coupler rod swiveling about the pivot axis.

13. The coupler according to claim 12, wherein the coupler pivot anchor further comprises a cage having an opening; wherein the pivot pin is fixedly attached to the cage; wherein the coupler rod extends through the opening of the cage, and wherein elastic elements are arranged inside the cage, the elastic elements resting against an inside wall of the cage and resting against an outer circumferential surface of the coupler rod.

14. A car of a multi-car vehicle, the car comprising:

a coupler comprising:

a coupler pivot anchor;

a coupler rod; and a device comprising:

a deflection arm connected to the coupler pivot anchor; and a drive connected to the deflection arm, wherein the drive is operative to rotate the deflection arm about the coupler pivot anchor;

wherein the drive has two parallel hydraulic or pneumatic cylinders and each of the two cylinders has a rod, wherein the two rods extend from the two parallel hydraulic or pneumatic cylinders in opposing longitudinal directions.

15. The car of claim 14, wherein the coupler further comprises a coupler head, said coupler head attached to the coupler rod, wherein said coupler head is deflectable by said device for aligning with a coupler head of another car.

16. A method for coupling a first car of a multi-car vehicle with a second car of a multi-car vehicle, wherein: the first car includes a first car coupler having a first car coupler head; and the second car includes a second car coupler having a second car coupler head; and wherein in a first position the coupler head of the first car is misaligned with the coupler head of the second car, the method comprising:

connecting a deflection arm of a device to a coupler pivot anchor of the first car coupler;

connecting a drive to the deflection arm, wherein the drive has two parallel hydraulic or pneumatic cylinders and each of the two cylinders has a rod, wherein the two rods extend from the two parallel hydraulic or pneumatic cylinders in opposing longitudinal directions;

driving the drive to rotate the deflection arm about the coupler pivot anchor to bring the first car coupler head into alignment with the coupler head of the second car.

17. The method of claim 16, further comprising:

providing the coupler pivot anchor with a pivot pin that extends along a pivot axis;

attaching a pivot anchor end of the deflection arm to the pivot pin of the coupler pivot anchor;

fixedly attaching the pivot pin to a cage of the coupler pivot anchor;

disposing a coupler rod within the cage;

wherein driving the drive to rotate the deflection arm about the coupler pivot anchor turns the pivot pin and the cage about the pivot axis, thereby causing the coupler rod to swivel about the pivot axis.

* * * * *